US010153596B2

(12) United States Patent
Lin et al.

(10) Patent No.: US 10,153,596 B2
(45) **Date of Patent: *Dec. 11, 2018**

(54) SHIELDED ELECTRICAL CONNECTOR HAVING TWO GROUNDING MEMBERS EACH WITH A PLURALITY OF CONTACTING ARMS

(71) Applicant: FOXCONN INTERCONNECT TECHNOLOGY LIMITED, Grand Cayman (KY)

(72) Inventors: Jun Lin, Kunshan (CN); Zhi-Jian Chen, Kunshan (CN); Lai-Ang Hu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/615,854

(22) Filed: Jun. 7, 2017

(65) Prior Publication Data

US 2017/0352992 A1 Dec. 7, 2017

(30) Foreign Application Priority Data

Jun. 7, 2016 (CN) ..... 2016 2 0543425 U

(51) Int. Cl.
*H01R 13/6591* (2011.01)
*H01R 12/70* (2011.01)
(Continued)

(52) U.S. Cl.
CPC ..... *H01R 13/6591* (2013.01); *H01R 12/7005* (2013.01); *H01R 13/115* (2013.01);
(Continued)

(58) Field of Classification Search
CPC ..... H01R 13/6591; H01R 13/6595; H01R 13/40; H01R 13/115; H01R 12/7005
(Continued)

(56) References Cited

U.S. PATENT DOCUMENTS 9,263,835 B2 * 2/2016 Guo ..... H01R 13/6596
9,590,360 B2 * 3/2017 Chuang ..... H01R 13/6581
(Continued)

*Primary Examiner* — Vanessa Girardi
(74) *Attorney, Agent, or Firm* — Wei Te Chung; Ming Chieh Chang

(57) ABSTRACT

An electrical connector includes an insulative housing, a plurality of conductive terminals retained in the insulative housing and two grounding members. The insulative housing defines an upper sidewall, a lower sidewall and two end walls connected to both ends of the upper and lower sidewalls to form a mating cavity. Each grounding member defines a body portion fixed to the outside of the insulative housing and a plurality of contacting arms. Each contacting arm defines a connecting portion extending forwardly from the body portion and a contacting portion bent inwardly from the connecting portion, and the upper and lower sidewalls of the insulative housing defines a plurality of channels and a plurality of ribs, the contacting portion of the grounding member protrudes into the mating cavity and the connecting portion abuts against the top surface of the rib to form a certain pre-pressure to the contacting arm.

17 Claims, 8 Drawing Sheets

(51) Int. Cl.

| | |
|---|---|
| ***H01R 13/115*** | (2006.01) |
| ***H01R 13/40*** | (2006.01) |
| ***H01R 13/6581*** | (2011.01) |
| ***H01R 13/6582*** | (2011.01) |
| *H01R 12/72* | (2011.01) |
| *H01R 13/62* | (2006.01) |

(52) U.S. Cl.
CPC ..... *H01R 13/40* (2013.01); *H01R 13/6581* (2013.01); *H01R 13/6582* (2013.01); *H01R 12/725* (2013.01); *H01R 13/6205* (2013.01)

(58) Field of Classification Search
USPC ..... 439/95, 108, 607.4, 607.55
See application file for complete search history.

(56) References Cited

U.S. PATENT DOCUMENTS

| | | | | |
|---|---|---|---|---|
| 9,853,399 | B2 * | 12/2017 | Kao | H01R 13/6585 |
| 2015/0072546 | A1 * | 3/2015 | Li | H01R 13/6585<br>439/96 |
| 2017/0352991 | A1 * | 12/2017 | Lin | H01R 13/6591 |

* cited by examiner

SHIELDED ELECTRICAL CONNECTOR HAVING TWO GROUNDING MEMBERS EACH WITH A PLURALITY OF CONTACTING ARMS

BACKGROUND OF THE INVENTION

1. Field of the Invention

The present invention relates to an electrical connector, and more particularly to an electrical connector having a better anti-EMI effect. This application is related to a copending application with the same applicant, the same title and the same filing date.

2. Description of the Related Art

With the development of the technology, an electrical connector for transmitting a high frequency signal and having an anti-EMI effect is very popular. Wherein one of the electrical connectors includes a housing formed of plastic material, two groups of conductive terminals retained within the housing and shielding member. The housing defines a receiving space for accommodating a mating connector, and the two groups of conductive terminals are arranged on both sides of the receiving space. The shielding member is disposed between the two groups of conductive terminals and spaced from the insulating blocks without being in contact with the conductive terminals, so that the arrangement of the shielding member effectively prevents electromagnetic interference of the conductive terminals. However, with the development of high-frequency transmission needs, the signal interference between the terminals become increasingly serious.

Therefore, an improved electrical connector is highly desired to meet overcome the requirement.

BRIEF SUMMARY OF THE INVENTION

An object of the present invention is to provide an electrical connector with a stable structure and a better anti-EMI effect.

In order to achieve above-mentioned object, an electrical connector includes an insulative housing, a plurality of conductive terminals retained in the insulative housing, a metal shell enclosing the insulative housing and two grounding members respectively assembled on the outside of the upper and lower sidewalls. The insulative housing defines an upper sidewall, a lower sidewall and two end walls connected to both ends of the upper and lower sidewalls, and the upper sidewall, the lower sidewall and the end walls collectively are formed a mating cavity. The conductive terminals are divided into two sets and received in the upper and lower sidewalls, respectively. Each grounding member defines a body portion fixed to the outside of the insulative housing and a plurality of contacting arms. Each contacting arm defines a connecting portion extending forwardly from the body portion and a contacting portion bent inwardly from the connecting portion, and the upper and lower sidewalls of the insulative housing defines a plurality of channels for receiving the contacting arms and a plurality of ribs disposed in corresponding channels, the contacting portion of the grounding member protrudes into the mating cavity and the connecting portion abuts against the top surface of the rib to form a certain pre-pressure to the contacting arm.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
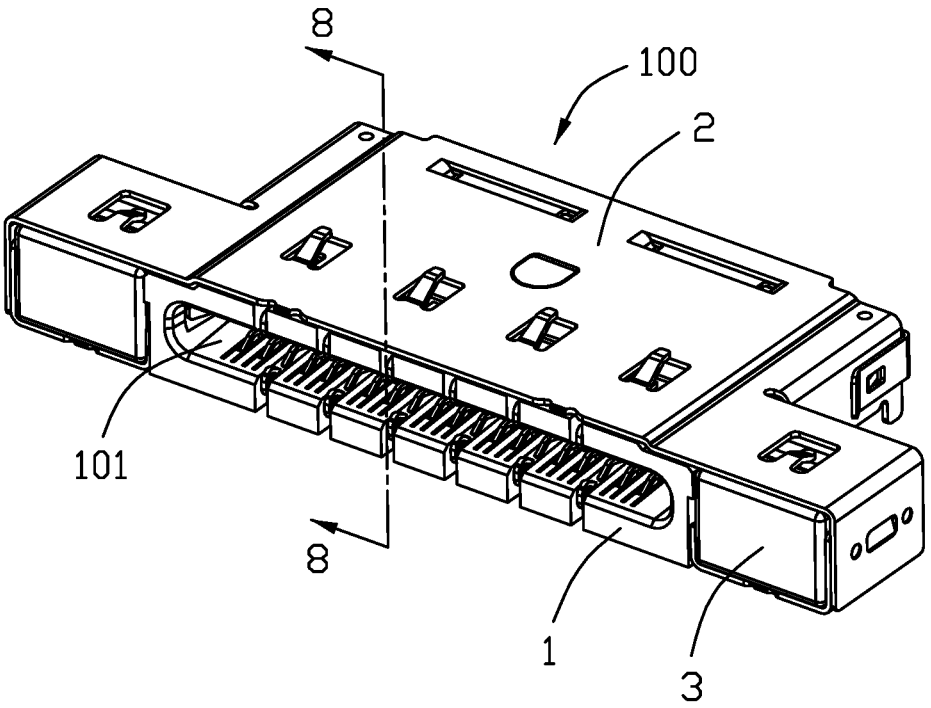
FIG. 1 is a perspective view showing an electrical connector in accordance with the present invention.
Figure 2:
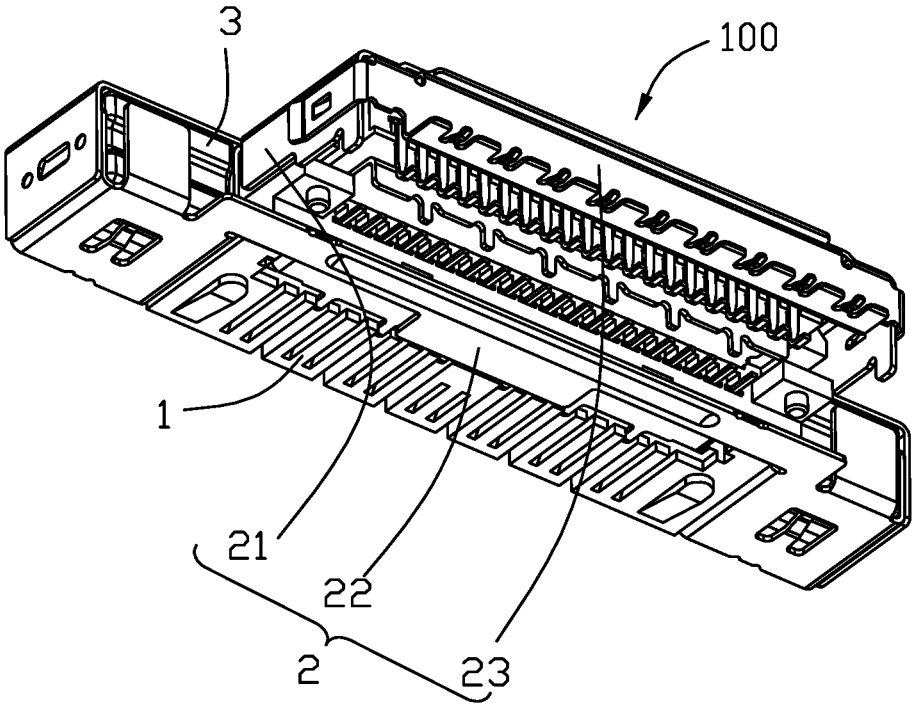
FIG. 2 is another perspective view of the electrical connector shown in FIG. 1.

Reference will now be made to the drawing figures to describe a preferred embodiment of the present invention in detail. Referring to FIG. 1 to FIG. 4, an electrical connector 100 is used for being mounted on a shell of an electronic device (not shown) and includes a terminal module 1, a metal shell 2 coated on the periphery of the terminal module 1 and a pair of magnetic elements 3 assembled on the metal shell 2 and located on both sides of the terminal module 1. The terminal module 1 defines a mating cavity 101 running through the front face thereof, and a mating connector (not shown) is inserted into the mating cavity 101 to form a mating state with the electrical connector 100.

Figure 5:
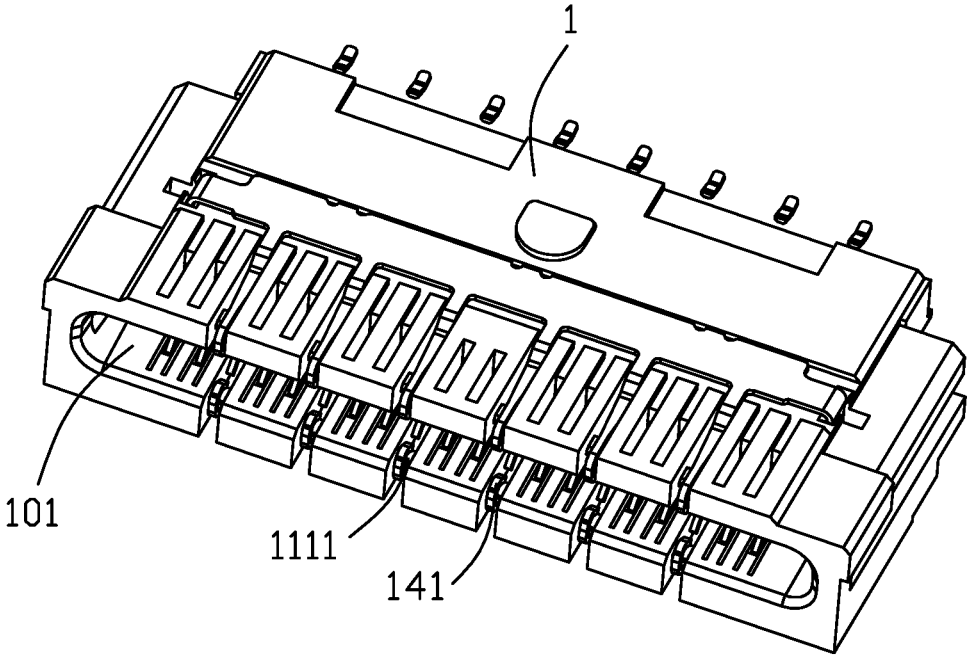
FIG. 5 is a perspective view of a terminal module of the electrical connector shown in FIG. 1.
Figure 6:
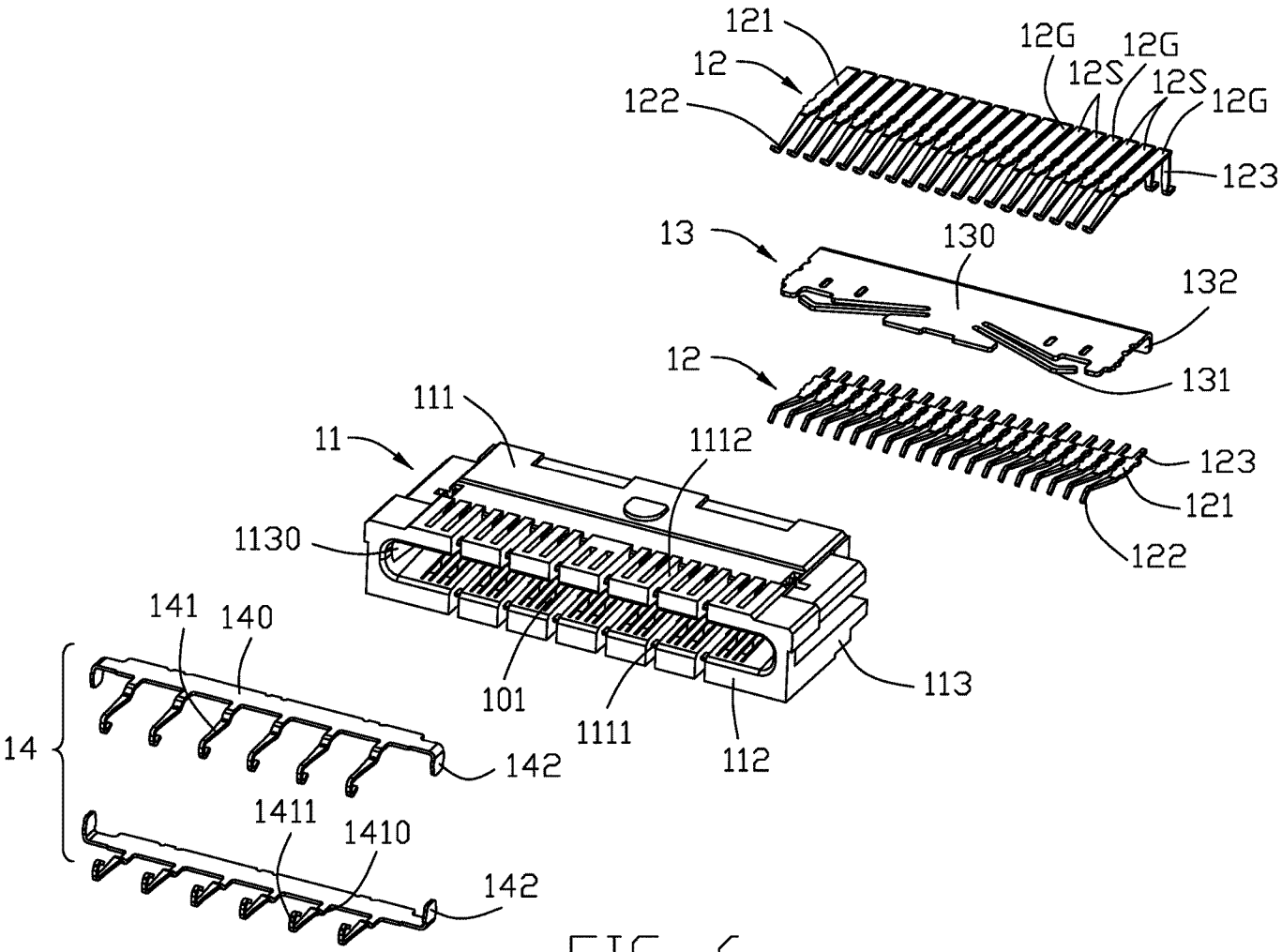
FIG. 6 is a partly exploded perspective view of the terminal module shown in FIG. 5.
Figure 7:
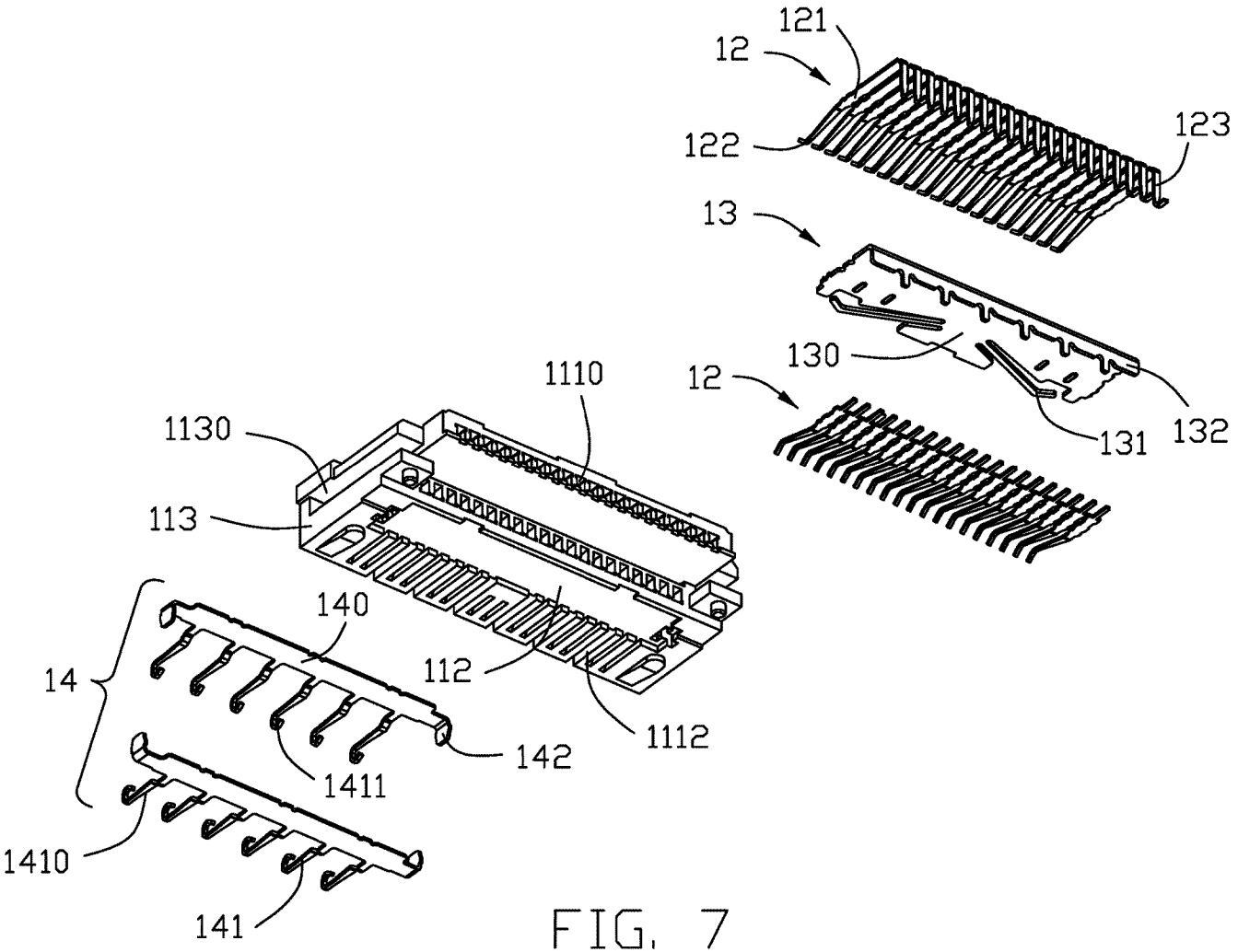
FIG. 7 is another partly exploded perspective view of the terminal module shown in FIG. 5.

Referring to FIG. 5 to FIG. 7, the terminal module 1 includes an elongated insulative housing 11, a plurality of conductive terminals 12 retained in the insulative housing 11 and a shielding member 13. The insulative housing 11 includes an upper sidewall 111, a lower sidewall 112 as the long side walls, and two end walls 113 as short side walls to be connected to both ends of the upper and lower sidewalls, and the upper sidewall 111, the lower sidewall 112 and the end walls 113 are collectively formed the mating cavity 101. Each of the upper sidewall 111 and the lower side wall 112 defines a plurality of terminal grooves/passageways 1110 for accommodating the conductive terminals 12 and communicating with the mating cavity 101, and each end wall 113 defines a recess 1130 communicating with the mating cavity 101.

The conductive terminals 12 are assembled into the insulative housing 11 from the rear side of the insulative housing 11, and the conductive terminals 12 are divided into two sets and arranged in the terminal grooves 1110 of the upper sidewall 111 and the lower sidewall 112. Each of the conductive terminals 12 defines a retaining portion 121 fixed to the insulative housing 11, a contacting portion 122 extending forwardly from the retaining portion 121 and projecting into the mating cavity 101 and a soldering portion 123 extending rearwardly and outside of the insulative housing 11. The shielding member 13 is assembled on the rear side of the insulative housing 11 and located between the two sets of conductive terminals 12. The shielding member 13 defines a horizontal shielding portion 130 retained in the insulative housing 11, a pair of elastic arms 131 extending inclined forward from the front end of the horizontal shielding portion 130 and projecting into the mating cavity 101, and a vertical shielding portion 132 extending vertically and downwardly from the rear end of the horizontal shielding portion 130.

The terminal module 1 further defines two grounding members 14 assembled on the outside of the insulative housing 11. Each of the grounding members 14 defines a body portion 140 attached to the outside of the insulative housing 11, a plurality of contacting arms 141 extending forwardly from the body portion 140 and a pair of overlapping portions 142 extending into the insulative housing 11 in the vertical direction from the longitudinal ends of the body portion 140. The conductive terminals 12 comprise a plurality of differential terminal pairs 12S and a plurality of grounding terminals 12G which are interval set, the contacting arms 141 are projecting into the mating cavity 101 and disposed in front of the grounding terminals 12G, so that the contacting arm 141 of the grounding member 14 may come into contact with the contacting area (not shown) of the mating connector before the contacting portion 122 of the grounding terminal. The overlapping portions 142 of the two grounding members 14 are overlapped with each other and are in contact with both longitudinal sides of the horizontal shielding portion 130 of the shielding member 13 while the overlapped portions 142 of the grounding member 14 are welded on both ends of the horizontal shielding portion 130 of the shielding member 13 by soldering or spot welding so that the grounding members 14 are integrated with the shielding member 13. It has a better masking effect when the electrical connector 100 is overlapped with the mating connector.

Figure 8:
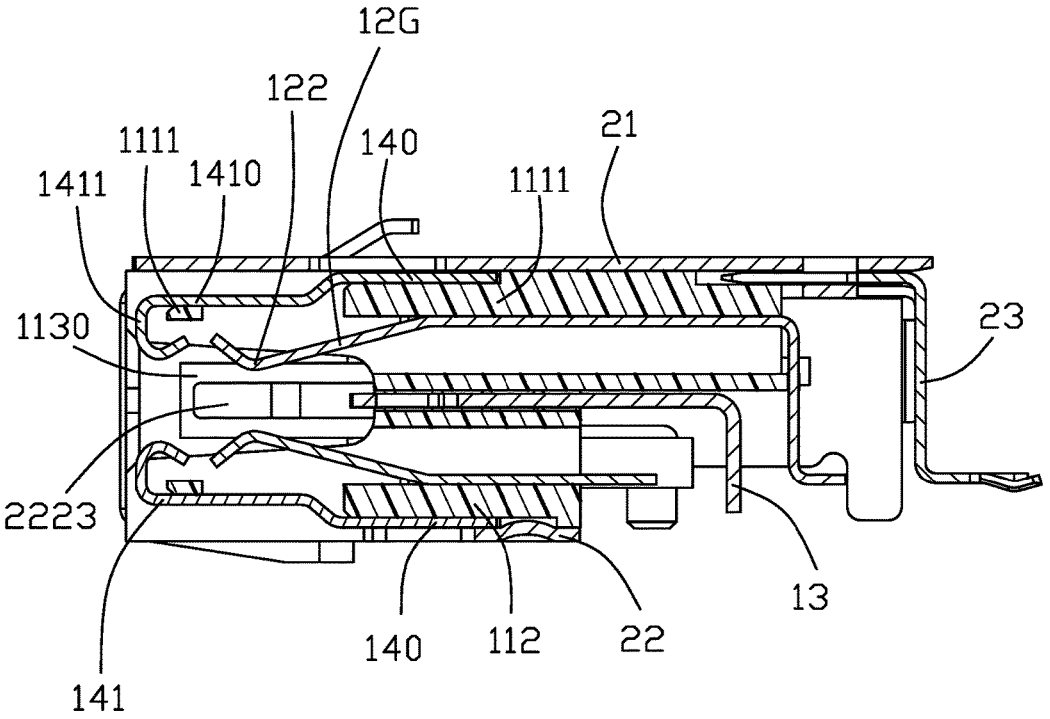
FIG. 8 is a cross-sectional view of the electrical connector taken along the line 8-8 shown in FIG. 1.

Referring to FIG. 8 to FIG. 9, the contacting arms 141 of the grounding member 14 are located in front of the contacting portions 122 of the grounding terminals and do not extend beyond the front face of the insulative housing 11. Each contacting arm 141 defines a connecting portion 1410 extending forwardly from the body portion 140 and a contacting portion 1411 bent inwardly from the front end of the connecting portion 1410. The upper and lower sidewalls of the insulative housing 11 define a plurality of channels 1112 for accommodating the contacting arms 141 and a plurality of ribs 1111 located in the corresponding channels 1112. The channel 1112 received contacting arm 141 runs through the front face of the insulative housing 11 while the channel 1112 also runs through the upper and lower surfaces of the corresponding upper and lower sidewalls to communicate with the mating cavity 101. The contacting portion 1411 of the grounding member 14 protrudes into the mating cavity 101 through the channel 1112 and the connecting portion 1410 abuts against the top surface of the rib 1111 to form a certain pre-pressure to the contacting arm 141. The contacting arm 141 of the grounding member 14 has a certain degree of elastic deformation before the mating connector is inserted so that there is no excessive elastic deformation when the mating connector is inserted, and the contact of the grounding member 14 with the mating connector is more stable. While the rib 1111 is located between the connecting portion 1410 and the contacting portion 1411 of the contacting arm 141 so that the contacting arm 141 is elastically deformed when the mating connector is inserted, and the contacting portion 1411 abuts against the bottom surface of the rib 1111, thereby preventing the contacting arm 141 from expanding excessively outwardly.

Figure 3:
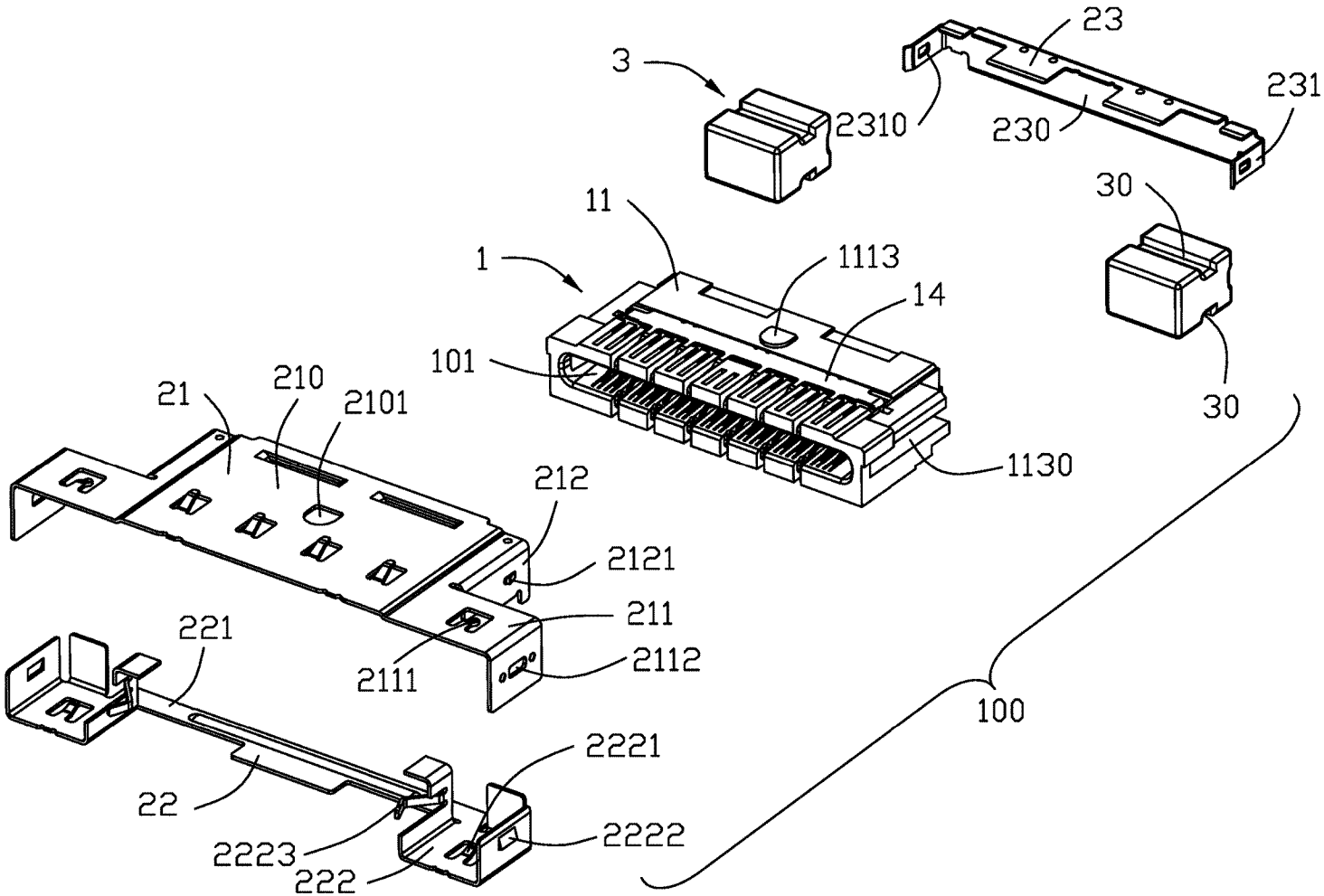
FIG. 3 is a partly exploded perspective view of the electrical connector shown in FIG. 1.
Figure 4:
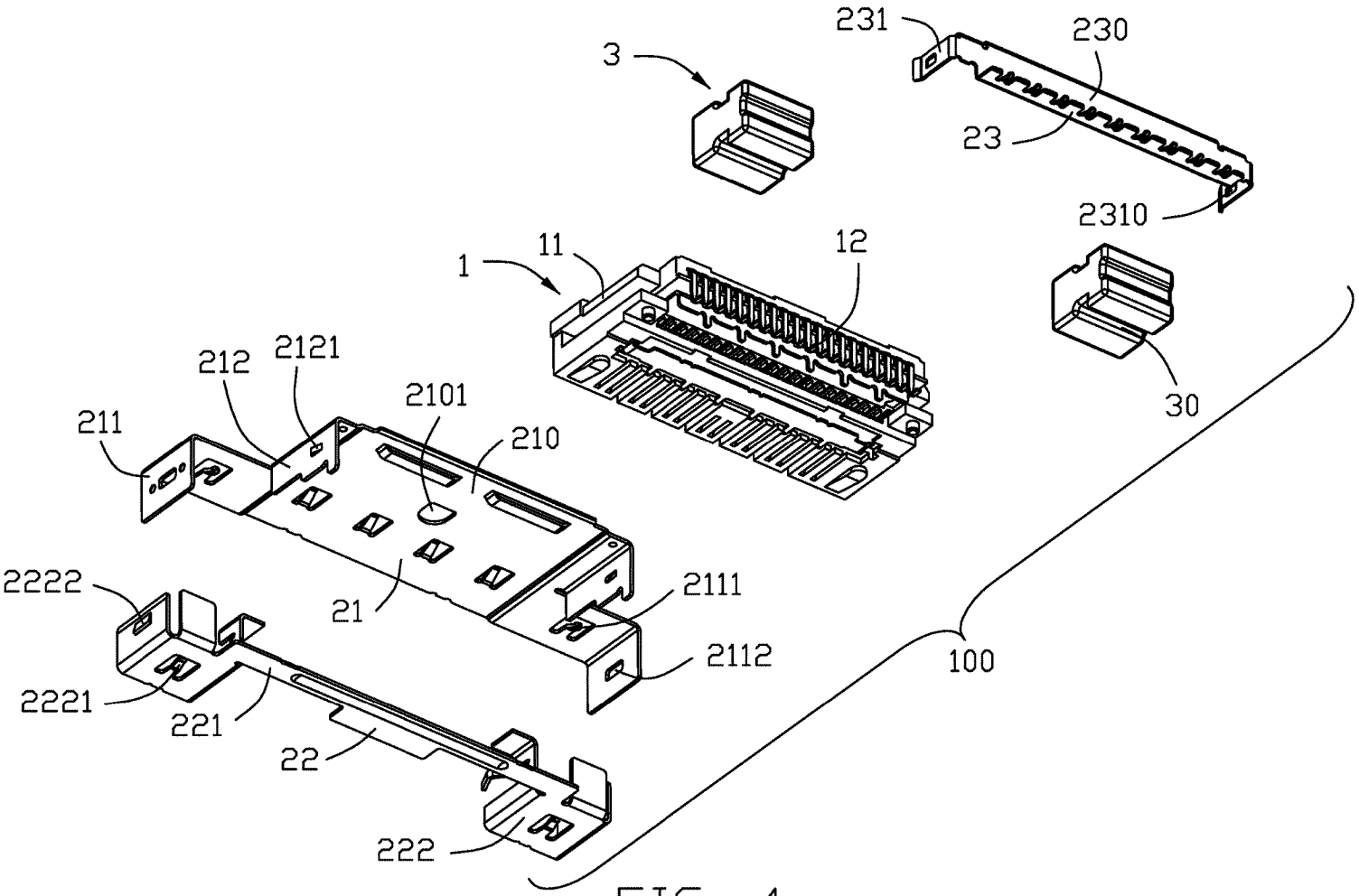
FIG. 4 is a partly exploded perspective view of the electrical connector shown in FIG. 2.

Referring to FIG. 3 to FIG. 4, the metal shell 2 includes an upper shell 21 and a lower shell 22 engaged with each other and a rear shell 23. The upper shell 21 includes a main portion 210 fit the surface of the upper sidewall 111 of the insulative housing 11, a pair of L-shaped front side portions 211 extending from both ends of the front side of the main portion 210 and a pair of rear side portions 212 extends downwardly from the rear side of the main portion 210. The lower shell 22 includes an elongated base portion 221 fit the middle surface of the lower sidewall 112 of the insulative housing 11 and a pair of U-shaped frame portions/rooms 222 disposed on both sides of the base portion 221 for accommodating the magnetic element 3. Each of the top surface and the bottom surface of the magnetic element 3 defines a slot 30, each of the L-shaped front side portions 211 of the upper shell 21 and the horizontal portions of the U-shaped frame portions/rooms 222 of the lower shell 22 defines a shrapnel 2111, 2221 corresponding to the slot 30 of the magnetic element 3, the shrapnels extend into the slot 30 of the magnetic element 3 and engage the magnetic element 30 so that the magnetic element 3 is fixed in the metal shell 2 and prevented coming off from the metal shell 2.

The upper shell 21 is engaged with the projection 1113 of the upper sidewall 111 of the insulative housing 11 through the through hole 2101 of the main portion 210 so that the upper shell 21 is fixed to the insulative housing 11. The L-shaped front side portion 211 of the upper shell 21 defines a front locking hole 2112 disposed in vertical portion thereof, and the vertical portion of the U-shaped frame portion 222 of the lower shell 22 defines a front protrusion 2222 corresponding to the front locking hole 2112. The front protrusion 2222 of the lower shell 22 is fixed in the front locking hole 2112 of the upper shell 21 so that the upper shell 21 and the lower shell 22 are electrically connected together. The rear shell 23 defines a vertical base portion 230 and a pair of overlapping plates 231 extending forwardly from the vertical base portion 230. The rear locking hole 2310 of the overlapping plate 231 is engaged with locking shrapnel 2121 on the rear side portion 212 of the upper shell 21, so that the rear shell 23 is electrically connected to the upper shell 21. While the U-shaped frame portion 222 of the lower shell 22 defines a resilient clamping arm 2223 extending through the recess 1130 of the insulative housing 11 into the mating cavity 101, the resilient clamping arm 2223 is used for engaging the grounding member (not shown) of the mating connector when the mating connector is inserted, to form a better masking effect.

Referring to FIG. 8, the body portions 140 of the two grounding members 14 are brought into contact with the main portion 210 of the upper shell 21 and the base portion 221 of the lower shell 22 so that the grounding members 14 come into contact with the upper and lower shell. As described above, the upper shell 21, the lower shell 22 and the rear shell 23 are hooked together, and the grounding member 14 is welded to the shield member 13, and the grounding member 14 is in contact with the metal shell 2, so that the metal shell 2, the grounding members 14 and the shielding member 13 are electrically and mechanically connected together as a unit to form a better electromagnetic mask effect. When the electrical connector 100 is brought into contact with the mating connector, the grounding members 14 come into contact with the grounding terminals of the mating connector before the grounding terminals of the electrical connector 100, thereby playing the role of eliminating static electricity, and further improving the electrical performance of the electrical connector 100. In this embodiment, the grounding member 14 is discrete from the shell 2 with a smaller thickness than that of the shell 2. It is because the shell 2 should be more rigid for supporting the housing and the magnetic element while the grounding member 14 should be resilient for having the contacting arms 141 intimately contacting the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining an upper sidewall, a lower sidewall and two end walls connected to both ends of the upper and lower sidewalls, and the upper sidewall, the lower sidewall and the end walls collectively formed a mating cavity;

a plurality of conductive terminals retained in the insulative housing, the conductive terminals being divided into two sets and received in the upper and lower sidewalls, respectively;

a metal shell enclosing the insulative housing; and two grounding members respectively assembled on the outside of the upper and lower sidewalls, each grounding member defining a body portion fixed to the outside of the insulative housing and a plurality of contacting arms; wherein each contacting arm defines a connecting portion extending forwardly from the body portion and a contacting portion bent inwardly from the connecting portion, and the upper and lower sidewalls of the insulative housing defines a plurality of channels for receiving the contacting arms and a plurality of ribs disposed in corresponding channels, the contacting portion of the grounding member protrudes into the mating cavity and the connecting portion abuts against the top surface of the rib.

2. The electrical connector as described in claim 1, wherein each set of the conductive terminals comprises a plurality of differential terminal pairs and a plurality of grounding terminals, and the contacting arms of the grounding members are arranged in front of the ground terminals.

3. The electrical connector as described in claim 2, wherein the electrical connector further comprises a shielding member assembled on the rear side of the insulative housing, the shielding member is located between the two sets of conductive terminals and defines a horizontal shielding portion retained in the insulative housing and a pair of elastic arms extending inclined forward from the front end of the horizontal shielding portion and projecting into the mating cavity, the grounding member further defines a pair of overlapping portions extending into the insulative housing in the vertical direction from the longitudinal ends of the body portion, the overlapping portions of the two grounding members are overlapped with each other and are in contact with both longitudinal sides of the horizontal shielding portion of the shielding member.

4. The electrical connector as described in claim 1, wherein the electrical connector further includes a pair of magnetic elements assembled in the metal shell and located on both sides of the insulative housing, the metal shell includes an upper shell and a lower shell engaged with each other and a rear shell, the magnetic elements are located between the upper and lower shells.

5. The electrical connector as described in claim 4, wherein the upper shell includes a main portion fit the surface of the upper sidewall of the insulative housing, a pair of L-shaped front side portions extending from both ends of the front side of the main portion and a pair of rear side portions extends downwardly from the rear side of the main portion, the lower shell includes an elongated base portion fit the middle surface of the lower sidewall of the insulative housing and a pair of U-shaped frame portions disposed on both sides of the base portion for accommodating the magnetic element.

6. The electrical connector as described in claim 5, wherein each of the top surface and the bottom surface of the magnetic element defines a slot, each of the L-shaped front side portions of the upper shell and the horizontal portions of the U-shaped frame portions of the lower shell defines a tab corresponding to the slot of the magnetic element, the tabs extend into the slot of the magnetic element and engage the magnetic element to form a latch.

7. The electrical connector as described in claim 5, wherein the end wall of the insulative housing defines a recess communicates with the mating cavity, the U-shaped frame portion of the lower shell defines a resilient clamping arm extending through the recess of the insulative housing into the mating cavity.

8. The electrical connector as described in claim 5, wherein the L-shaped front side portion of the upper shell defines a front locking hole disposed in vertical portion thereof, and the vertical portion of the U-shaped frame portion of the lower shell defines a front protrusion corresponding to the front locking hole, the front protrusion of the lower shell is fixed in the front locking hole of the upper shell so that the upper shell and the lower shell are electrically connected together.

9. The electrical connector as described in claim 8, wherein the rear shell defines a vertical base portion and a pair of overlapping plates extending forwardly from the vertical base portion, the rear locking hole of the overlapping plate is engaged with a locking tab on the rear side portion of the upper shell, so that the rear shell is electrically connected to the upper shell.

10. An electrical connector comprising:

an insulative housing including two opposite long sides walls and two opposite short side walls commonly forming a mating cavity forwardly exposed to an exterior in a front-to-back direction;

a plurality of passageways formed in each other said long side walls;

a plurality of conductive terminals disposed in the corresponding passageways, respectively, said terminals including grounding terminals, each of said terminals including a contacting portion extending into the mating cavity; and a metallic grounding member attached upon an exterior face of one of the long side walls and forming a plurality of contacting arms forwardly extending beyond the contacting sections of the terminals in said front-to-back direction, and aligned with the corresponding grounding terminals in a vertical direction perpendicular to said front-to-back direction; wherein said one of the long side walls forms a plurality of channels to receive the corresponding contacting arms therein, and a plurality of ribs are formed in the corresponding channels, respectively, to support the corresponding contacting arms.

11. The electrical connector as claimed in claim 10, wherein each of said channels extends through said one of the long side walls in the vertical direction and a front end face of the said one of the long side walls.

12. The electrical connector as claimed in claim 10, further including a metallic shell enclosing the housing and the grounding member wherein a thickness of the shell is larger than that of the grounding member.

13. The electrical connector as claimed in claim 12, wherein said shell forms a pair of rooms by two sides of the housing in a transverse direction perpendicular to both said front-to-back direction and the vertical direction, to receive a pair of magnetic elements, respectively.

14. The electrical connector as claimed in claim 10, wherein each of said contacting arms includes a connecting portion inwardly abutting against the corresponding rib in the vertical direction, and a contacting portion located at a front end of the connecting portion and forming a rearward extension in said front-to-back direction.

15. The electrical connector as claimed in claim 14, wherein a contacting point of the contacting portion of said contacting arm is located in front of a contacting point of the corresponding grounding terminal in the front-to-back direction, and is located on an outer side of the contacting point of the grounding terminal in the vertical direction.

16. The electrical connector as claimed in claim 14, wherein the passageways receiving the connecting portions of the corresponding terminals and located beside the channels, extend through the corresponding side wall in the vertical direction.

17. The electrical connector as claimed in claim 14, wherein the contacting portion of the contacting arms is partially overlapped with the corresponding rib in the vertical direction.

* * * * *